United States Patent [19]

Kumm et al.

[11] Patent Number: 4,559,761

[45] Date of Patent: Dec. 24, 1985

[54] METHOD FOR TRANSPORTING INSULATION TO A WORK AREA

[76] Inventors: William H. Kumm; John H. Kumm, both of 511 Heavitree La., Severna Park, Md. 21146

[21] Appl. No.: 468,963

[22] Filed: Feb. 23, 1983

Related U.S. Application Data

[63] Continuation of Ser. No. 169,035, Jul. 15, 1980, abandoned.

[51] Int. Cl.[4] ..... B65B 9/06; B65B 11/48

[52] U.S. Cl. ..... 53/397; 53/429; 53/461; 52/741; 138/128; 414/786; 414/787

[58] Field of Search ..... 52/741, 743; 53/396, 53/397, 429, 430, 461; 138/128; 206/400, 417; 224/153; 414/786, 787

[56] References Cited

U.S. PATENT DOCUMENTS

| | | | |
|---|---|---|---|
| 2,558,367 | 6/1951 | Madsen | 138/128 X |
| 2,756,172 | 7/1956 | Kidd | 138/128 |
| 2,968,858 | 1/1961 | Brenner et al. | 206/417 X |
| 3,517,702 | 6/1970 | Mueller et al. | 138/128 |
| 4,235,060 | 11/1980 | Wang et al. | 52/743 |

*Primary Examiner*—Robert L. Spruill
*Assistant Examiner*—Michael D. Folkerts
*Attorney, Agent, or Firm*—Eric P. Schellin

[57] ABSTRACT

A method and insulation transport device for transporting building-type rolled insulation or batts of insulation through an opening in a building to an area to be insulated, such as a crawl space, in which the opening to the area to be insulated is of less diameter than that of the roll of insulation or package of batts.

3 Claims, 5 Drawing Figures

METHOD FOR TRANSPORTING INSULATION TO A WORK AREA

This is a continuation of application Ser. No. 169,035 filed July 15, 1980, and now abandoned.

BACKGROUND OF THE INVENTION

1. Field of the Invention

This invention relates to insulation of crawl spaces or other hard to reach spaces of a building and more particularly to a means and method of safely transporting the insulation to the area of interest.

2. Prior Art

It is well known that insulation for buildings may be purchased in rolls or linear batts in which insulation material including rock wool or glass fibers are secured to a backing sheet of paper stock or of an aluminum foil. Typical glass fiber insulation rolls are formed by long strips of insulation rolled about its width or lateral axis and are of the following sizes as purchased from a merchant or manufacturer:

| INSULATION VALUE | WIDTH | LENGTH | PACKAGED ROLL DIAMETER | NOTES |
|---|---|---|---|---|
| R11 | 15¼" | 38'6" | 26" | Plain or Foil Faced |
| R11 | 23" | 70'6" | 26" | Plain or Foil Faced |
| R19 | 23" | 39'2" | 26" | Plain or Foil Faced |

Insulation batts may have the same insulation value, width and facing but is only about 4 feet in length and packaged with several batts in a package.

In order to insulate hard to reach spaces, such as crawl spaces in the attic of a building the insulation rolls are unrolled prior to transportation to the attic and the batts-type is removed from its package. This is especially true for insulating those areas which have a small opening through which the rolls or packages of batts can not be passed when packaged as purchased. Since the insulation rolls are unrolled prior to being carried to the place to be insulated, the backing may become damaged, the insulation may be torn loose from the backing, and glass fibers may come loose and contaminate the air which is breathed. Loose fibers are injurious to the health and torn or damaged insulation may not insulate the area as required.

SUMMARY OF THE INVENTION

A long, narrow heavy plastic or other type of flexible material having a width and length greater than the insulation to be transported is provided with securing means on its edges to enclose the insulation in a longitudinal roll. By enclosing the insulation in a longitudinal roll, the insulation may be passed through a small opening having a diameter, which is considerably less than that of the diameter of a rolled roll of insulation in its regular rolled form and not enclosed within the flexible material.

It is therefore an object of the invention to transport building-type insulation to hard to reach spaces without damage to the insulation while protecting the workman from harmful effects of the insulation.

Another object is to prepare the insulation for passage through small openings without damage to the insulation when passed through the small opening.

DETAILED DESCRIPTION

Figure 1:
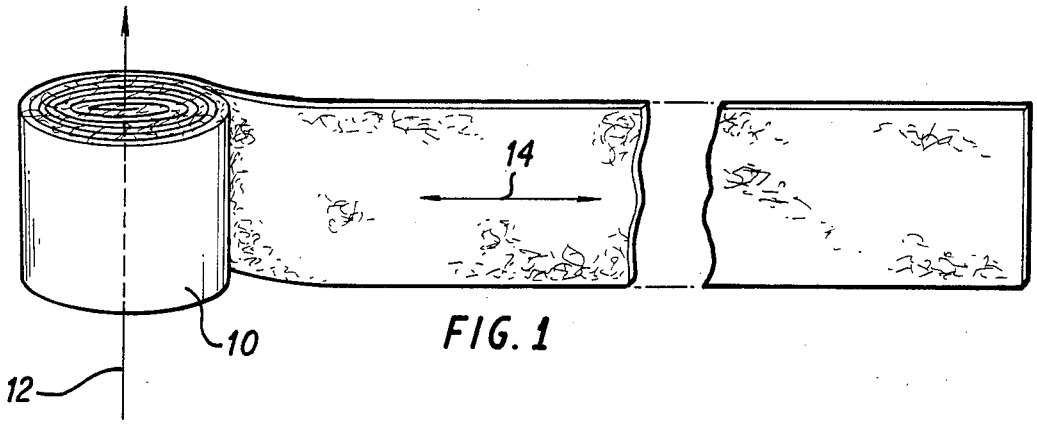
FIG. 1 represents a roll of insulation partially unrolled.

Referring to the drawings wherein like references represent like parts in the different views, there is shown in FIG. 1 a roll of insulation 10, which is partially unrolled to better illustrate the relative structure. For illustrative purposes, the line 12 represents the lateral axis about which the insulation roll is rolled and the arrow 14 represents the longitudinal axis which will be explained later.

Figure 2:
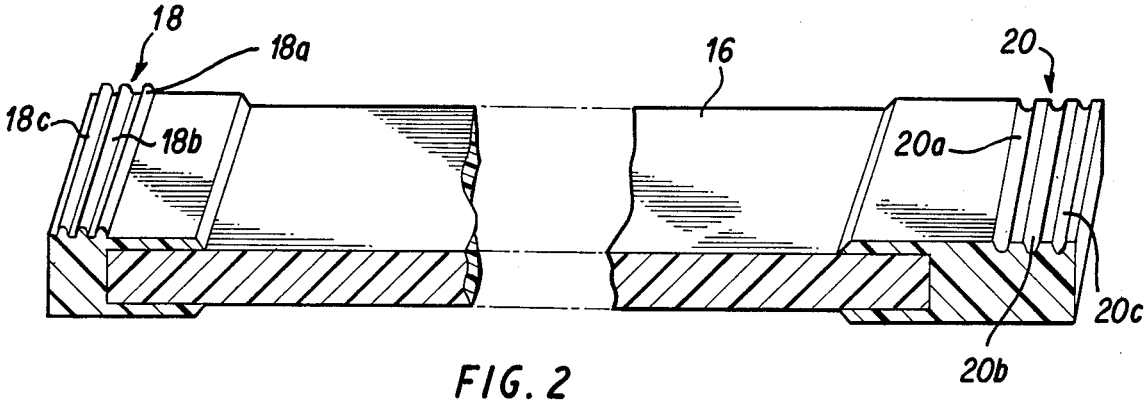
FIG. 2 is an enlarged transverse or lateral cross-sectional view of an elongated plastic or fabric material for transporting insulation through a small opening to the space of interest.
Figure 3:
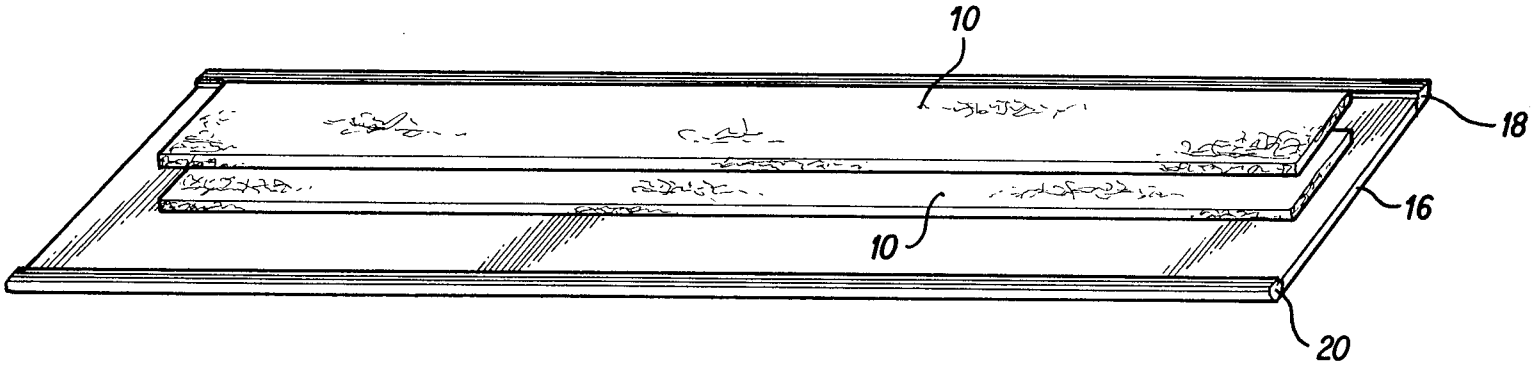
FIG. 3 illustrates a plastic or fabric material with two unrolled rolls of insulation thereon.

FIGS. 2 and 3 illustrate a strip of plastic or fabric material 16 including a male edge 18 and a female edge 20. The male edge has ridges **18*a*, 18*b* and 18*c* which may be pressed into valleys 20*a*, 20*b* and 20*c*** in the female edge so that they fit together, such as a plastic zipper in order to form an enclosure when zipped together. The strip of plastic material is wider than the width of a roll of insulation and is longer in length than the roll of insulation in its unrolled state. The male and female edges are shown as separate parts molded to the edges of the plastic sheet. The plastic sheet could be made with thicker edges and the male and female structure formed along the thicker edge portions. Plastic zippers are well known in the art and the zipper structure may be made with well known practices in the art. The important thing is, that the edges of the transport material be connected together along the length of the transport device so that the insulation may be enclosed therein for transport.

Figure 4:
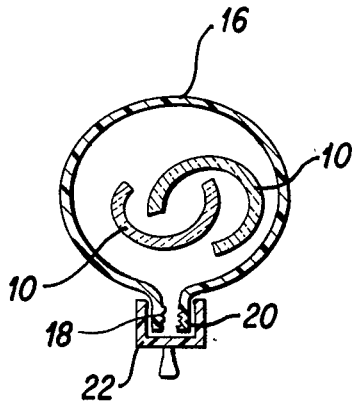
FIG. 4 is a cross-sectional view illustrating two insulation strips assembled within the plastic or fabric material encircling the insulation.

FIG. 3 illustrates the insulation transport material laid out flat with two rolls 10 of insulation unrolled along the length of the transport material. The transport material must be of a length which is longer than that of the insulation when unrolled, and of a width which is wider than the width of the insulation, as shown. The insulation transport device in accordance with the teaching of this invention is rolled along its longitudinal axis 14, shown in FIG. 1, and its edges are secured together beginning at one end while enclosing the insulation therein as the transport device is rolled about its longitudinal axis. The edges of the transport device are secured together from one end to the other. The insulation transport device is made of a plastic or fabric, which is flexible so that transport device with the insulation therein will be flexible. Since the insulation is rolled along its longitudinal axis the completed roll within the transport device is much smaller than the roll of insulation as purchased when rolled about its lateral axis. It is obvious from FIG. 4, which illustrates two unrolled rolls of insulation therein, that the insulation enclosed within the transport device will pass through a much smaller opening than it would in its original roll. FIG. 4 further illustrates a means 22 for forcing the edges of the transport device together. The means 22 is also made to separate the edges for removal of the insulation once the insulation has been transported to its desired space in the building.

Figure 5:
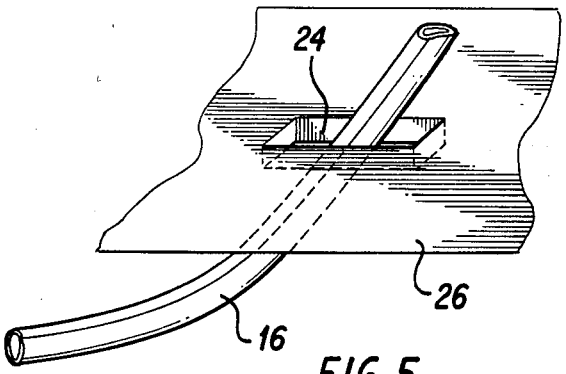
FIG. 5 illustrates a plastic or fabric material enclosure with insulation therein being passed through a small opening into an area for use.

FIG. 5 illustrates an opening 24 in a building structure 26 through which the insulation transport device with insulation enclosed therein may be passed for transporting the insulation to a desired work area. A longitudinally rolled transport device with insulation therein is shown being passed through the opening.

In carrying out the teaching of the invention, the plastic insulation transport material enclosure of sufficient width and length is spread out in its open form in an open work area such as outside of a building. One roll of insulation is laid upon the open plastic material and unrolled with each end of the insulation within the length of the plastic material. The plastic material transport device is then rolled along the longitudinal axis and zipped along its edges to enclose the length of insulation. More than one layer of insulation may be laid-out on the plastic material, as shown, if the opening through which the plastic material insulation transport means is to be passed is sufficiently large to pass more than one roll of insulation. Of course, if the opening is not large enough to handle more than one bundle of insulation at the same time, only one bundle will be enclosed within the plastic material transport device.

Once the transport device with the insulation enclosed therein has been passed through the opening to the area to be insulated, the transport device is unzipped and the insulation removed. The insulation may be removed by flipping the plastic transport device which will lay the insulation flat. In the event the insulation is to be placed above the ceiling in the spaces between joists of a lower room, the insulation should be laid on the transport device with the foil side up so that when it is flipped-over, the foil side will be down in proper order to be placed in between the joists. Also, if the insulation is to be placed in the rafters, the insulation will be placed on the transport device with the foil up. When flipped, the insulation will be in the proper position for raising the insulation to the rafters.

Once the insulation has been removed from the transport device, the transport device is passed back through the opening to be reloaded with one or more unrolled rolls of insulation.

It will be obvious to one skilled in the art that batts of insulation may be placed upon an opened transport device with the batts laid end to end along the length of the transport device and the transport device rolled along its longitudinal axis and zipped together. In this manner, several batts can be transported to the work area at the same time. More than one layer of batts may be placed on the transport device, provided the opening, through which the loaded transport device is passed, is sufficiently large to pass the transport device with more than one layer of batts therein.

The insulation transport device has been shown with the linear edges zipped together which form an upstanding ridge. It will be obvious that the female slots could be on the other side of the linear edge so that the male linear edge would overlap the female edge and join together to form a more flat enclosure. The particular zipper used does not add or substract from the invention, but relates to one manner of securing the edges of the insulation transport device together so that an enclosure is formed. Other means for closing the device may be used without detracting from the invention. Plastic zippers are well known in the art for various uses. Such zippers may be used in this invention.

We claim:

1. A method of transporting building type insulation from a work area through a small opening within a building to be insulated which comprises:

laying a sheet of re-usable flexible material upon a surface said sheet having means for closing said flexible material along its linear edges and being of a width and length which is greater than the width and length of the insulation to be transported;

laying a roll of insulation upon said sheet of flexible material and unrolling the insulation with its longitudinal axis parallel with the longitudinal axis of said sheet of flexible material and the ends of the insulation spaced inwardly from the ends of the sheet;

rolling said sheet of flexible material and said insulation together along their longitudinal axis and securing said sheet of flexible material in its rolled condition, thereby enclosing said insulation within the confines of said sheet of flexible material;

passing said rolled sheet of flexible material with said insulation therein through said small opening in said building to the area to be insulated;

opening said rolled sheet of flexible material; and removing said insulation from said unrolled sheet of flexible material and reloading the removed unrolled sheet of re-usable flexible material with one or more unrolled lengths of insulation.

2. A method as claimed in claim 1, wherein said sheet of flexible material is closed along its longitudinal edges.

3. A method of transporting commercially rolled insulation from an outdoor work area into a building and through a small opening within said building, which comprises the steps of laying a re-usable flexible material having closure means along its linear edges, said material having a width and length greater than the width and length of the said insulation, to be transported, said material being of plastic or fabric;

unrolling said rolled insulation longitudinally on said flexible material;

rolling said sheet of flexible material and said insulation together along their longitudinal axis and securing said sheet of flexible material in its rolled condition, thereby enclosing said insulation within the confines of said sheet of flexible material;

passing said rolled sheet of flexible material with said insulation therein through said small opening in said building to the area to be insulated;

opening said rolled sheet of flexible material; and removing said insulation from said unrolled sheet of flexible material and reloading the removed unrolled sheet of re-usable flexible material with one or more unrolled lengths of insulation.

* * * * *